US006866206B2

(12) United States Patent
Wu

(10) Patent No.: US 6,866,206 B2
(45) Date of Patent: Mar. 15, 2005

(54) DRINKING FOUNTAIN BUBBLER GUARD

(76) Inventor: Cheng-Wsiung Wu, No. 71, Tsao kang Lane, Tsao Chung Li, Lu kang Town, Changhua Country (TW)

( * ) Notice: Subject to any disclaimer, the term of this patent is extended or adjusted under 35 U.S.C. 154(b) by 0 days.

(21) Appl. No.: 10/441,069

(22) Filed: May 20, 2003

(65) Prior Publication Data

US 2004/0232255 A1 Nov. 25, 2004

(51) Int. Cl.[7] ..... B05B 12/14; B56D 25/40; E03B 9/20

(52) U.S. Cl. ..... 239/24; 222/566; 222/570

(58) Field of Search ..... 239/24; 222/566, 222/570

(56) References Cited

U.S. PATENT DOCUMENTS 2,172,306 A * 6/1939 Zinkil et al. ..... 239/24
3,329,345 A * 7/1967 Scott ..... 239/24
3,921,903 A * 11/1975 Grimes et al. ..... 239/24
4,009,806 A * 3/1977 Dreibelbis et al. ..... 222/545
4,060,198 A * 11/1977 Dreibelbis et al. ..... 239/24
4,232,825 A * 11/1980 Berry, Jr. ..... 239/28

* cited by examiner

*Primary Examiner*—William C Doerrler
(74) *Attorney, Agent, or Firm*—Rabin & Berdo, P.C.

(57) ABSTRACT

An improved drinking fountain bubbler guard in which the guard of the invention herein is installed at an opposite angle to the front of the bubbler pedestal. The present invention is an L-shaped guard with a round bonding facet that is conjoined to the anterior extremity of the spigot cock; a gasket is postured against the guard, the spout is inserted through the gasket and then fastened into the output hole of the spigot cock such that the guard is tightly mounted onto the spigot cock. As such, the invention herein safely protects the face of served users and effectively prevents accidents, while also reducing paper cup usage and thereby complying with environmental protection objectives.

3 Claims, 3 Drawing Sheets

DRINKING FOUNTAIN BUBBLER GUARD

BACKGROUND OF THE INVENTION

1) Field of the Invention

The invention herein relates to water dispensing fixtures, specifically an improved drinking fountain bubbler guard, wherein the said guard is of pliant plastic construction as opposed to the one-piece metal fabricated approach of conventional structures.

2) Description of the Prior Art

Drinking fountains are in widespread use at schools, offices, and other public venues. They are typically of one-piece stainless steel or brass construction. Since drinking fountain-related accidents continue to occur, the many cases of injury resulting suggests that an alternative to such construction is needed.

In view of this situation, removing the means of physical impact and squeezing presented by such fixtures will effectively reduce facial injuries as well as the frequency of accidents.

The applicant of the invention herein addressed the problem with conventional drinking fountain bubbler guards based on many years of engagement in the drinking fountain industry by examining the shortcomings of the conventional products in order to prevent accidents that result in facial injury, which culminated in the successful development of the improved drinking fountain bubbler guard of the invention and the submitting of a new patent application as a solution for the said existent difficulties.

SUMMARY OF THE INVENTION

The objective of the invention herein is to provide a drinking fountain bubbler guard that is fabricated of a pliant plastic material into an L-shaped component that has a round bonding facet and conjoined to the anterior extremity of the spigot cock for the purpose of accident prevention, paper cup usage reduction, and environmental protection compliance.

In addition to said structural arrangement and purposes, the spigot cock and the guard are separable, independent components that minimize packaging dimensions, thereby facilitating portability and lowering export shipping costs, but still retaining the function of a conventional bubbler guard.

DETAILED DESCRIPTION OF THE INVENTION

Figure 1:
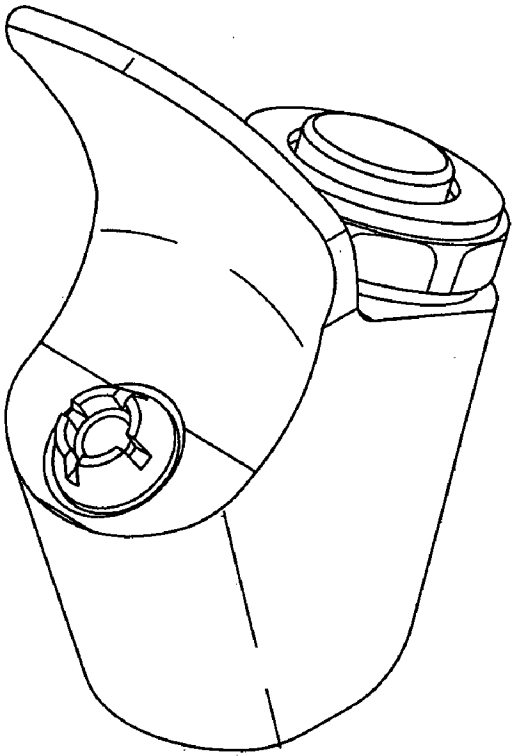
FIG. 1 Prior Art
FIG. 1 is an isometric drawing of a conventional assembly.
Figure 2:
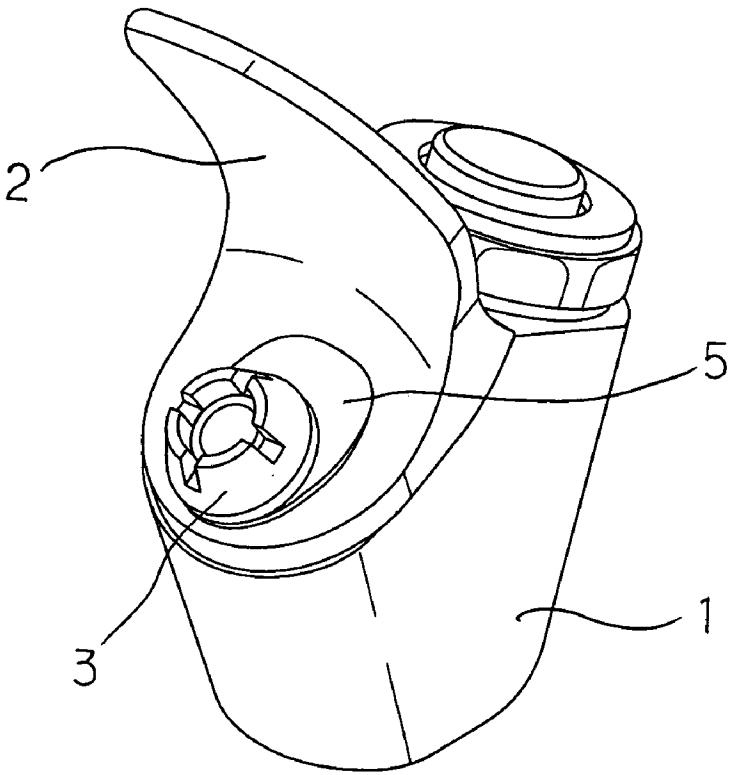
FIG. 2 is an isometric drawing of the invention herein.
Figure 3:
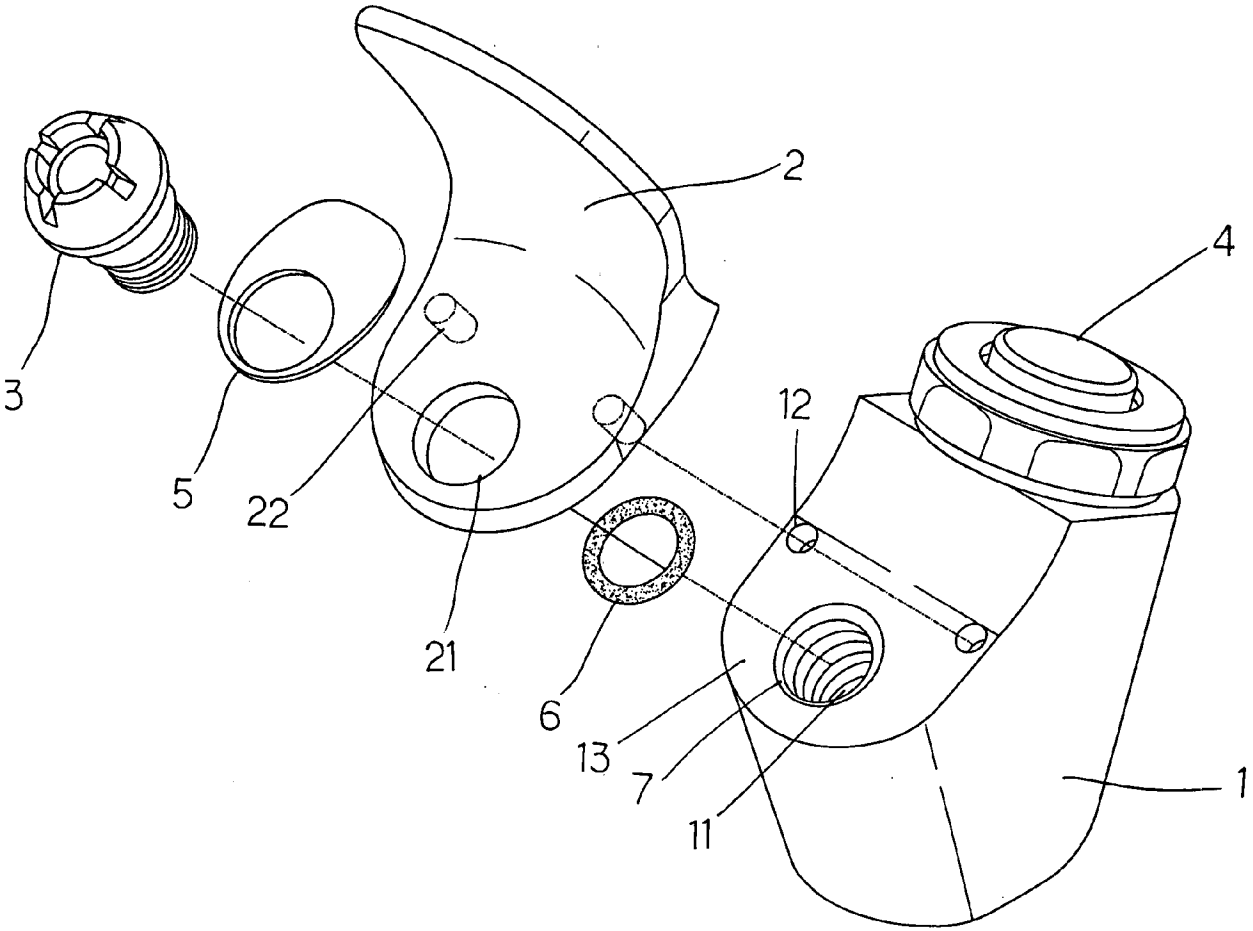
FIG. 3 is an exploded drawing of invention herein.

Referring to FIG. 3, the exploded drawing of the invention herein, the improved drinking fountain bubbler guard of the invention herein is installed at an opposite angle to the front of the bubbler pedestal and the said bubbler is comprised of a spigot cock 1, a guard 2, and a spout 3; the spigot cock 1 has a threaded hole 11, a round bonding facet 13, and a groove 12 in its anterior extremity, with a push button actuator 4 at its posterior extremity; the guard 2 has an opening 21, with pins 22 projecting from its bottom section for attachment to the round bonding facet 13; and the spout 3 has external threads along its bottom portion; an inner rim 7 is formed at the entrance of the threaded hole 11, an elastomeric washer 6 is seated in the inner rim 7, and the spout 3 is fastened into the threaded hole 11 in the spigot cock 1; the features are that the said spigot cock 1 is of metal construction, while the guard 32 is fabricated of a pliant plastic material into an L-shaped component that is profiled such that the bottom section is congruent with the round bonding facet 13 at the anterior extremity of the spigot cock 1 and, furthermore, effectively conjoined into position on the spigot cock 1 by the union of the pins 22 and the groove 12; a gasket 5 is placed onto the guard 2 and the said gasket 5 has a hole formed into it; the spout 3 is inserted through the gasket 5, the guard 2, and the elastomeric washer 6 and then fastened into the output hole 11 of the spigot cock 1 such that the guard 2 is tightly mounted on the spigot cock 1 in a design that is safe and protective.

To further assist the review of the invention herein by the examination committee, the practical advantages of present invention are as follows:

(1) The drinking fountain bubbler guard of the invention herein safely shields the face of served users and reduces paper cup usage, thereby complying with environmental protection concepts.

(2) The invention herein has packaging dimensions that facilitate portability and lower export shipping costs.

In summation of the foregoing section, since the improved drinking fountain bubbler guard of the invention herein possesses manufacturing utility and is progressive, the invention herein meets new patent application requirements.

What is claimed is:

1. An improved drinking fountain bubbler that is installed at an opposite angle to the front of a bubbler pedestal, comprising:

a spigot cock having disposed in its anterior extremity a bonding facet, a groove formed along the bonding facet, an output hole, and a push button actuator situated at the rear;

a bubbler guard; and, a spout fastened through an opening in the bubbler guard to the output hole;

wherein the bubbler guard has a bottom section that is congruent with the bonding facet of the spigot cock and, furthermore, is effectively conjoined into position on the spigot cock by inserting pins projecting from the bubbler guard into the groove.

2. The improved drinking fountain bubbler of claim 1, wherein the bubbler guard is fabricated of a pliant plastic material into an L-shaped component having the bottom section that is congruent in shape with the bonding facet.

3. The improved drinking fountain bubbler of claim 1, wherein the guard has a gasket placed on it and a hole is formed in the gasket; and the spout is inserted through the gasket and fastened into the output hole of the spigot cock, thereby enabling the secure mounting of the bubbler guard onto the spigot cock.

* * * * *